US005943842A

United States Patent [19]

de Koning et al.

[11] Patent Number: 5,943,842

[45] Date of Patent: Aug. 31, 1999

[54] ADJUSTABLE SUCTION HEAD APPARATUS FOR PACKAGING ARTICLES

[75] Inventors: Johannes J. de Koning, Mechanicsville; Frederick W. McCook, Jr.; Thomas J. Halish, both of Richmond, all of Va.

[73] Assignee: Flexicell, Inc., Richmond, Va.

[21] Appl. No.: 08/995,941

[22] Filed: Dec. 22, 1997

[51] Int. Cl.[6] ..... B65B 1/04

[52] U.S. Cl. ..... 53/247; 53/543; 294/65

[58] Field of Search ..... 294/64.1, 64.2, 294/64.3, 65; 53/247, 539, 543, 544, 446

[56] References Cited

U.S. PATENT DOCUMENTS 3,506,140 4/1970 Koch et al. .
3,934,920 1/1976 Rowenkamp .
4,832,180 5/1989 Ferrero .
5,222,861 6/1993 Focke et al. ..... 294/65
5,743,068 4/1998 Madariaga ..... 53/247

*Primary Examiner*—John Sipos
*Assistant Examiner*—Steven Jensen
*Attorney, Agent, or Firm*—Laubscher & Laubscher

[57] ABSTRACT

A packaging device for lifting a loosely spaced set of articles from a supply conveyor, compressing the set of articles by eliminating the excess space between them, and placing the compressed set of articles into a receiving container is characterized by a frame, a vacuum housing rigidly mounted on the frame, a plurality of pickup assemblies extending downwardly from the vacuum housing, and an apparatus for shifting the plurality of pickup assemblies between an expanded loading configuration which corresponds to the spacing of the set of articles on a conveyor and a compressed unloading configuration which corresponds to the spacing required for the set of articles to be deposited in a container.

6 Claims, 7 Drawing Sheets

ADJUSTABLE SUCTION HEAD APPARATUS FOR PACKAGING ARTICLES

BACKGROUND OF THE INVENTION

The present invention relates to a packaging device and, more particularly, to a packaging device capable of grasping a plurality of articles such as serving cups from a conveyor, displacing the articles together in order to remove the excess space existing between them, and placing the compacted plurality of articles into a container.

In some packaging operations, articles are transported to a packager along a conveyor apparatus having multiple rows of widely spaced articles due to requirements of their manufacture. Direct packaging of such articles can be inefficient due to the wasted space between the articles. This inefficiency ultimately results in the use of large containers to hold a relatively small number of articles. An automated packaging device capable of receiving a widely spaced group of articles and tightly compacting the group for placement into a relatively compact container is therefore useful for efficient packaging.

BRIEF DESCRIPTION OF THE PRIOR ART

Presently, there are several devices known for packaging articles. Some of the devices afford variable spacing of individual articles, however, all of the devices suffer from significant drawbacks.

The U.S. Patent to Ferrero No. 4,832,180, for example, discloses a pickup device including a plurality of suction type pickup members, a plurality of mutually parallel support members, and a drive which enables the distance between adjacent support members to be varied. More particularly, the distance between the support members may be varied while the device is transferring articles carried by the pickup members to a package so as to adapt the separation between the rows of articles to the dimensions of the package itself. In one embodiment, it is also possible to vary the lateral spacing between the pickup members, and therefore, displace the articles within two dimensions.

In the Rowekamp U.S. Pat. No. 3,934,920, there is disclosed an apparatus for lifting tightly spaced bottles from cases, spreading the rows apart, and placing the bottles on a bottle conveyor having spaced lanes. The Koch, et al. U.S. Pat. No. 3,506,140 discloses a method and apparatus for removing eggs from a transport container in which the eggs are arranged in spaced perpendicular rows and placing them into an incubation tray in which the eggs are tightly packed.

The present invention avoids the intricate mechanical designs of these prior devices by providing a packaging device which utilizes a set of spaced parallel plates which cooperate with a plurality of double conical members to shift a plurality of pickup assemblies between an expanded configuration corresponding to the spacing of a conveyor and a compressed configuration corresponding to the spacing of a receiving container. The device is used to transport spaced articles from the conveyor to fit within the container.

SUMMARY OF THE INVENTION

Accordingly, a primary object of the present invention is to provide a packaging device for grasping a set of loosely disbursed articles from a supply conveyor, compressing the set of articles by eliminating the excess space between them, and placing the compressed set of articles into a receiving container. The packaging device repeats these steps to deposit consecutive layers of articles atop each other until the container has been filled. The device includes a frame, a vacuum housing rigidly mounted on the frame, a plurality of pickup assemblies extending downwardly from the vacuum housing, and an apparatus for shifting the pickup assemblies between an expanded loading configuration which corresponds to the spacing of the articles on the conveyor and a compressed unloading configuration which corresponds to the spacing required for the articles to be deposited in a container.

It is another object of the invention to provide a suction type packaging device in which it is possible to adapt the relative position between the articles to be packed within a two dimensional plane to achieve the most compact configuration.

It is a further object of the invention to provide a packaging device which uses two spaced parallel plates, each having a plurality of openings which are partially aligned, to shift the plurality of pickup assemblies between loading and unloading configurations by displacing the parallel plates relative to a double sided conical member mounted on each of the pickup assemblies.

BRIEF DESCRIPTION OF THE DRAWINGS

Other objects and advantages of the invention will become apparent from a study of the following specification when viewed in the light of the accompanied drawings, in which.

DETAILED DESCRIPTION

Figure 1:
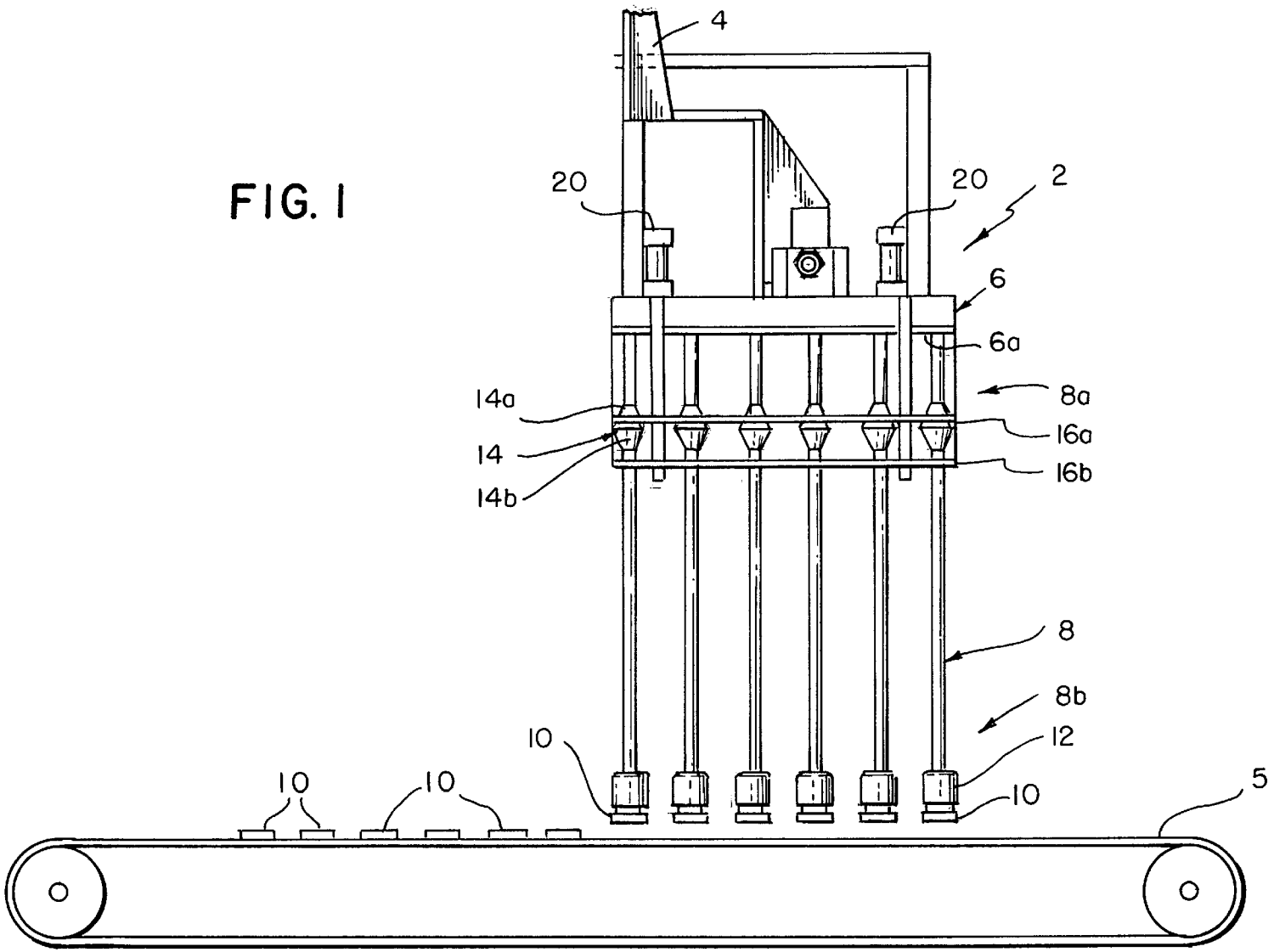
FIG. 1 is a detailed view of the packaging device in the loading configuration for grasping articles from a supply conveyor according to the invention.

Referring to FIG. 1, there is shown a packaging device 2 according to the invention. The device 2 includes a frame 4 which supports and transfers the packaging device 2 between a position over a loading conveyor 5 and a position over a receiving container. The packaging device 2 also includes a vacuum housing 6 which is rigidly connected with the frame 4. The vacuum housing 6 has a bottom wall 6*a* containing a plurality of openings. A plurality of pickup assemblies 8 are connected with the bottom wall 6*a* at each opening and extend generally downward therefrom. Each pickup assembly 8 has an upper portion 8*a* pivotally connected with its respective opening in the bottom wall 6*a* of the vacuum housing 6 such that it is capable of universal angular displacement about its respective connection. The lower portions 8*b* of the pickup assemblies 8 are adapted for grasping articles 10 and are pneumatically linked to the vacuum housing 6 for receiving vacuum pressure. The articles 10 are grasped by various suction driven methods such as suction cups 12. Adjacent to the upper portions 8*a* of the pickup assemblies 8, there is mounted a conical member 14 including an upper conical surface 14*a* which tapers toward the upper portion 8*a* and a lower conical surface 14*b* which tapers toward the lower portion 8*b*.

Figure 2:
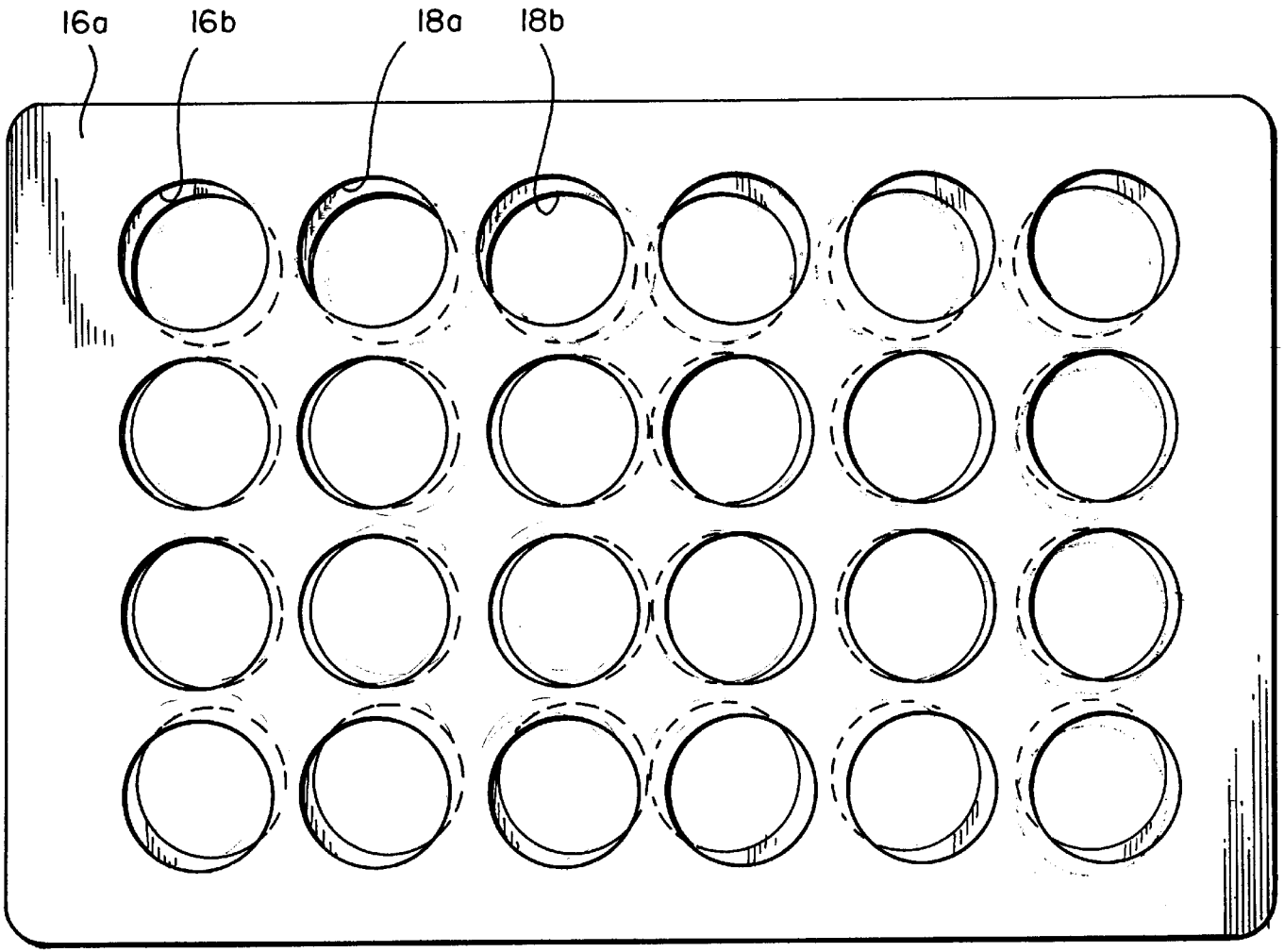
FIG. 2 is a top plan view of the parallel plates of the packaging device according to the invention.

A set of spaced parallel horizontal plates 16*a* and 16*b* are displaceably connected with the vacuum housing 6. As shown in FIG. 2, each of the plates 16*a* and 16*b* has an equal number of openings 18*a* and 18*b* positioned in a pattern that is unique to each plate. The plates are rigidly mounted to each other and as a result, the corresponding openings of the plates are slightly misaligned with respect to the lower plate's 16*b* openings 18*b*. The parallel plates are positioned beneath the vacuum housing 6 so that each pickup assembly 8 and a portion of its respective conical member 14 passes through corresponding openings in both plates 16*a* and 16*b*.

Figure 3:
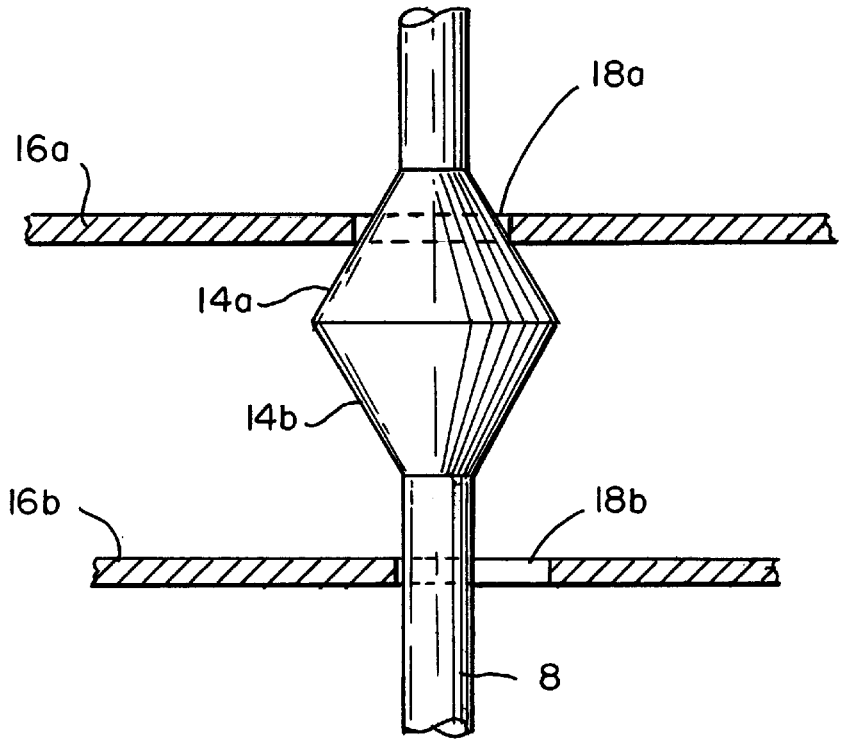
FIG. 3 is a partial sectional view of a pickup assembly in the loading configuration showing one of the double conical members disposed between the parallel plates according to the invention.
Figure 4:
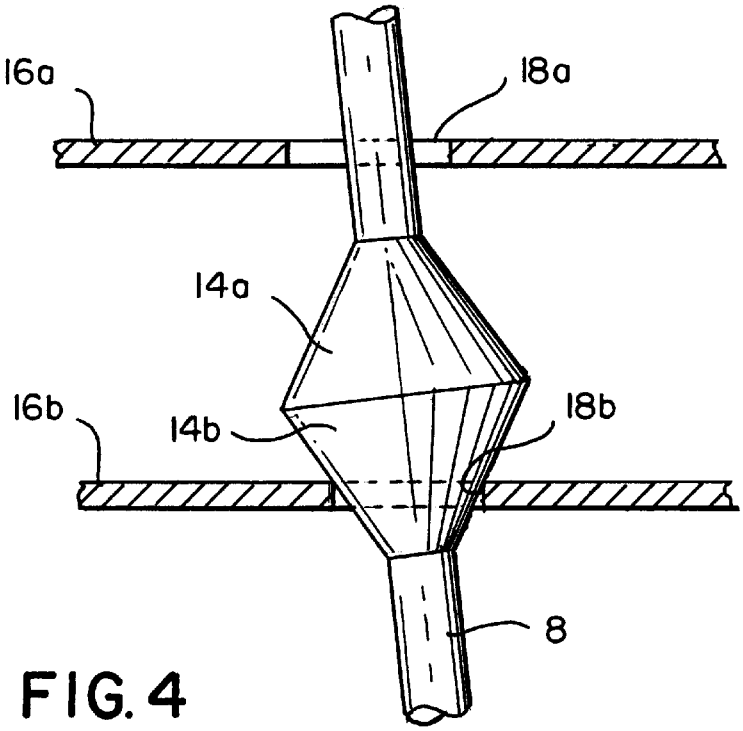
FIG. 4 is a partial sectional view of a pickup assembly in the unloading configuration showing one of the double conical members disposed between the parallel plates according to the invention.

In operation, the plates 16*a* and 16*b* are vertically displaced by a pair of pneumatic jacks 20 between a loading location remote from the vacuum housing 6 (FIG. 3) and an unloading location adjacent to the vacuum housing 6 (FIG. 4). As shown in FIG. 3, when the parallel plates 16*a* and 16*b* are vertically displaced away from the vacuum housing 6, the upper plate opening 18*a* engages the upper conical surface 14*a* of a pickup assembly 8 to displace the pickup assembly toward the expanded configuration. As shown in FIG. 1, while the pickup assemblies 8 are in the expanded loading configuration, they are aligned so that their lower portions 8*b* correspond to the positioning of articles 10 on a loading conveyor 5 which supplies the device 2.

Figure 5:
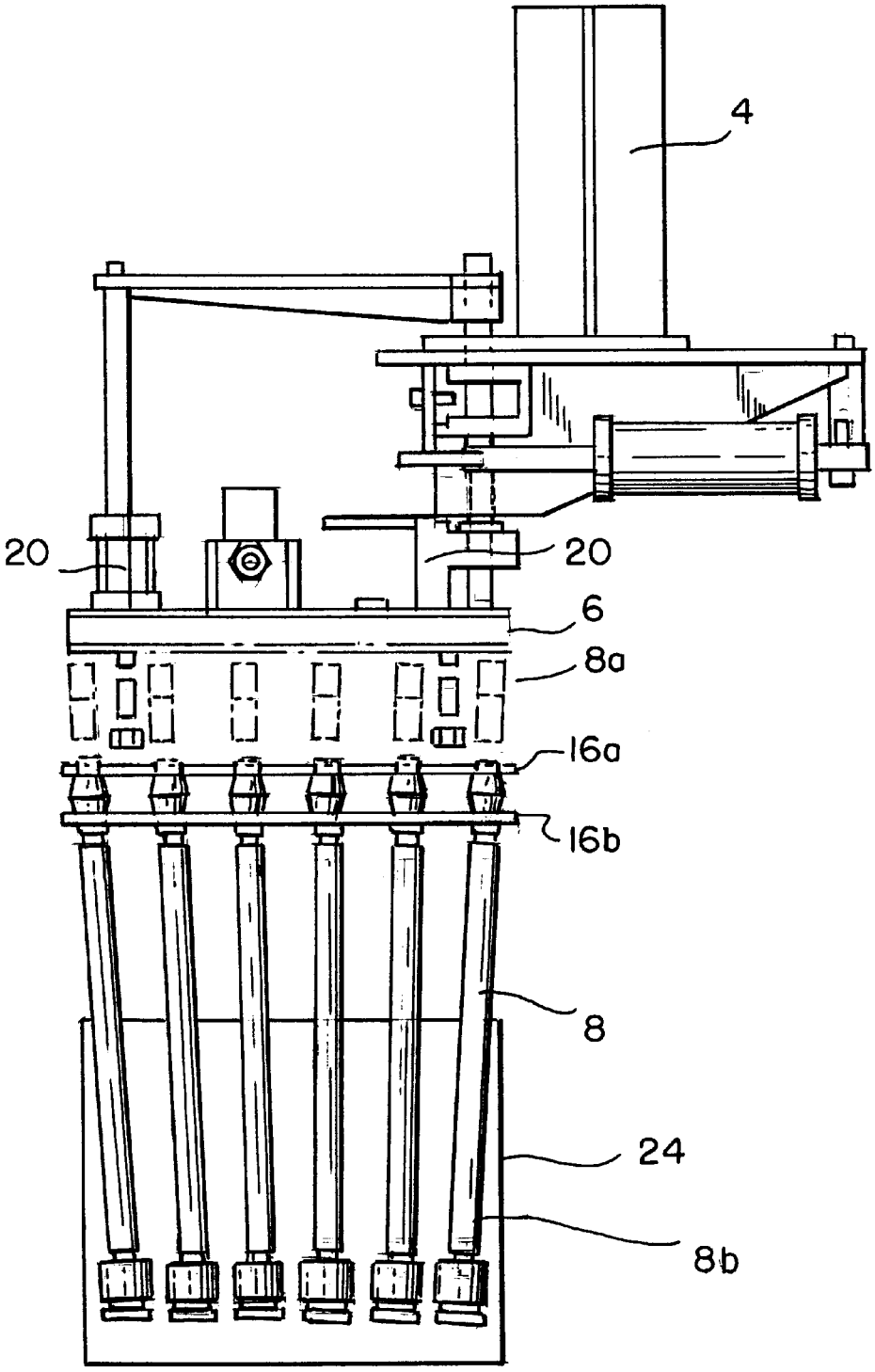
FIG. 5 is a detailed view of the device in the unloading configuration according to the invention.

In a similar manner, when the plates 16*a* and 16*b* are vertically displaced towards the vacuum housing 6 as shown in FIG. 4, the lower plate opening 18*b* engages the lower conical surface 14*b* of the pickup assembly 8 to displace the pickup assembly toward the unloading configuration. As shown in FIG. 5, while the pickup assemblies 8 are in the compressed unloading configuration, their lower portions 8*b* are aligned to correspond to the positioning of the articles 10 within a container 24.

In use, the entire device 2 is positioned over the loading conveyor 5 and the pickup assemblies 8 are shifted into the loading configuration to engage and lift widely spaced articles 10 from the conveyor 5. The device 2 is then repositioned over the container 24 while the pickup assemblies 8 are shifted into a compressed unloading configuration. The device 2 is then lowered into the container 24 where the compactly positioned articles 10 are deposited. The process is repeated as necessary to place consecutive layers atop each other until the container has been filled. The full container is then removed and replaced by an empty one.

Various configurations can be achieved by altering the pattern of openings 18 on the plates 16*a* and 16*b* to match the spacing of articles on a conveyor 5 or the spacing within a container 24. Also, the number and placement of the pickup assemblies 8 can be altered to match the requirements of a specific packaging site.

Figure 6:
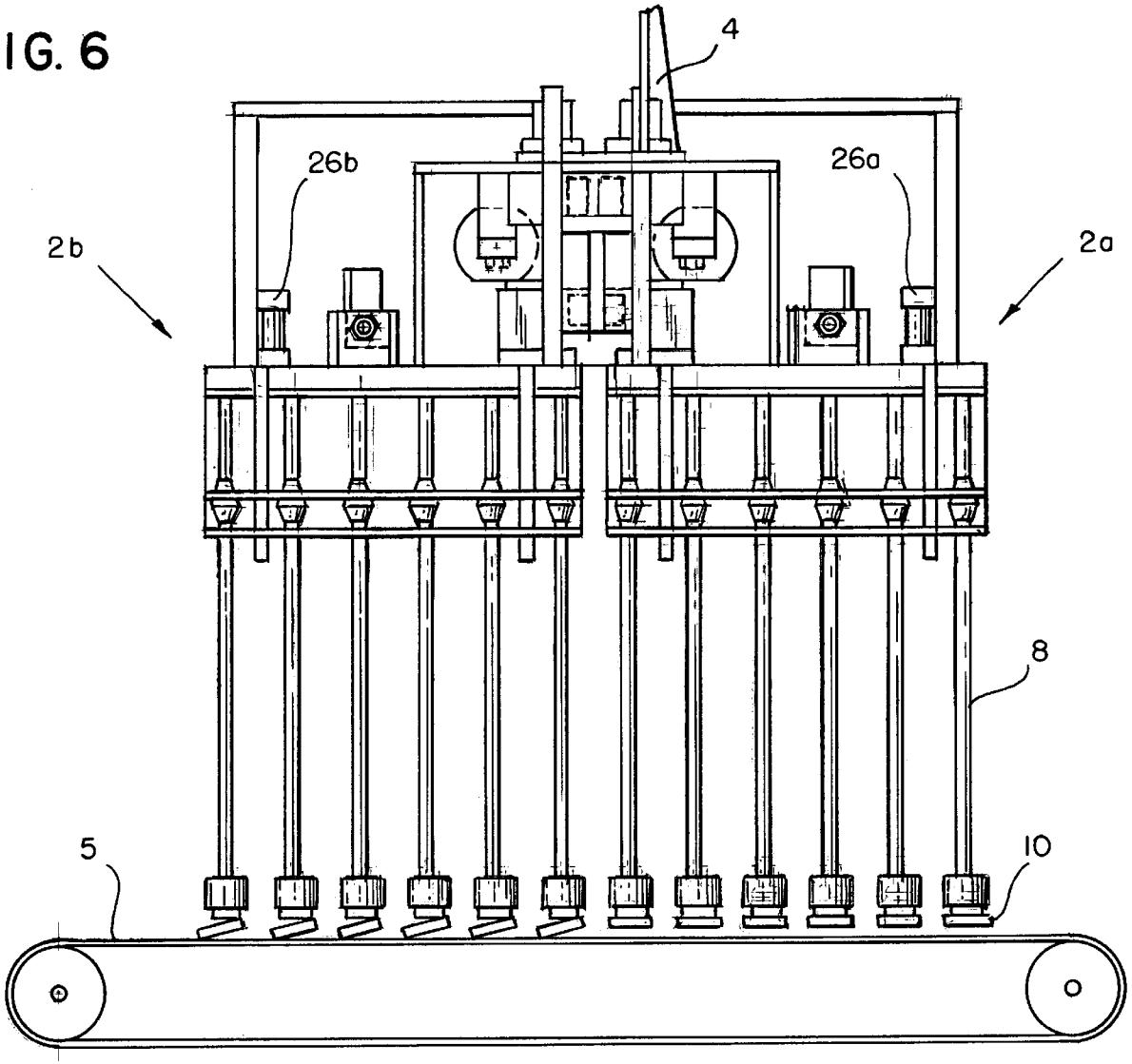
FIG. 6 is a detailed view of a second embodiment of the invention in the loading configuration for grasping articles from a conveyor.

In an alternative embodiment shown in FIG. 6, two of the packaging devices 2*a* and 2*b* are pivotally mounted on the frame 4 for displacement between a loading position and an unloading position by a pair of pneumatic cylinders 26*a* and 26*b* connected between the frame 4 and its respective packaging device 2*a* or 2*b*.

Figure 7:
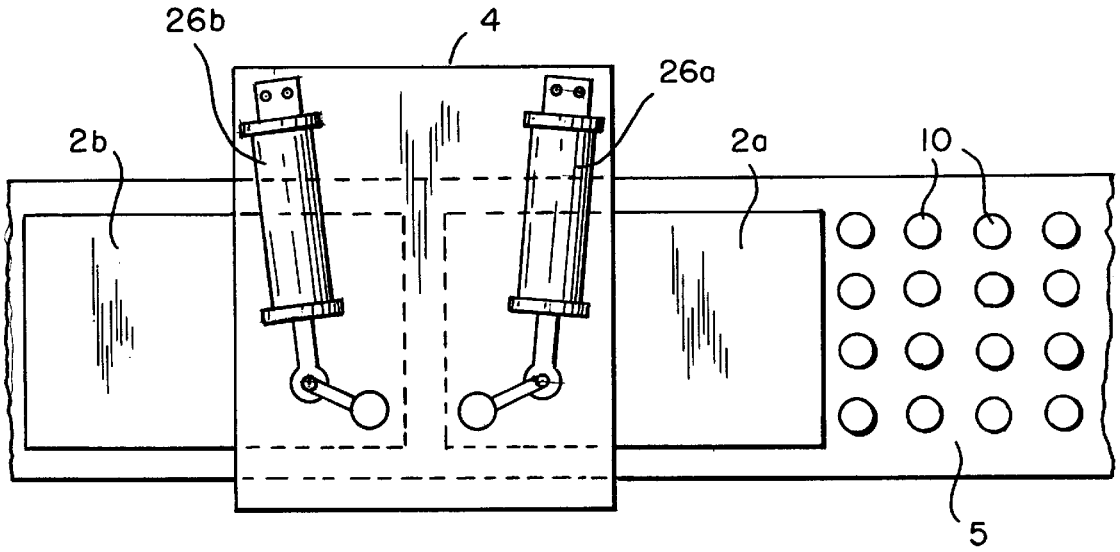
FIGS. 7 and 8 are top plan views of the second embodiment of the invention in the loading and unloading configurations, respectively.
Figure 8:
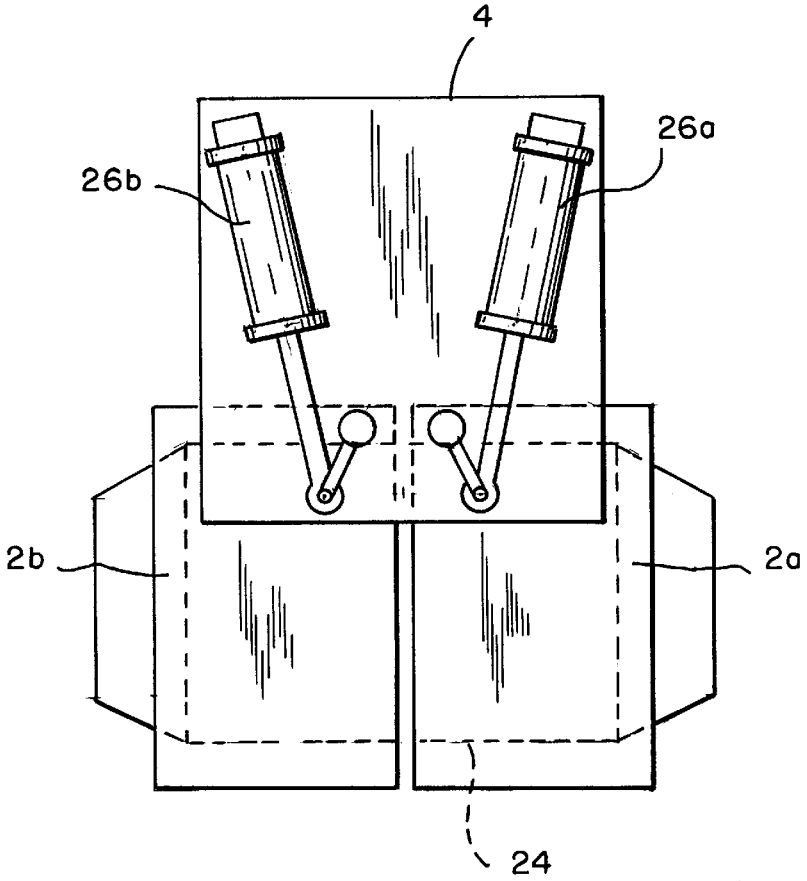
Figure 9:
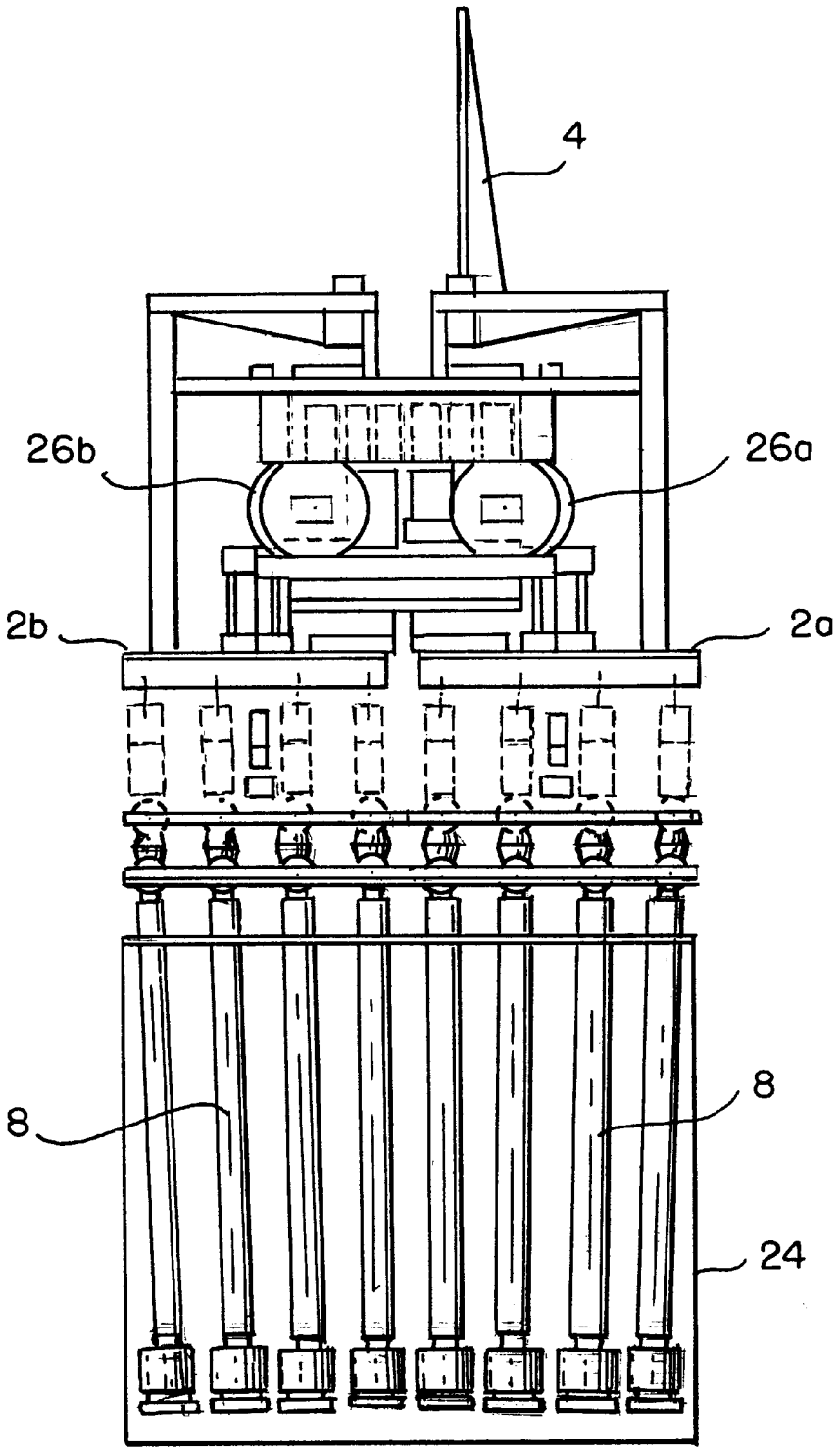
FIG. 9 is a detailed view of the second embodiment of the invention in the unloading configuration.

While in the loading position, the pneumatic cylinders 26*a* and 26*b* are retracted as shown in FIG. 7, and each of the pickup assemblies 8 of the packaging devices are in the expanded configuration aligned with their lower portion 8*b* positioned over a conveyor 5 for grasping the articles 10 thereon. Once grasped, the entire frame 4 is repositioned over a receiving container 24. During repositioning, each of the packaging devices 2*a* and 2*b* are rotated forward 90° in the same horizontal plane with a scissor like motion (FIG. 8) while their pickup assemblies 8 are shifted into a compressed unloading configuration (FIG. 9) so as to have their lower portion 8*b* positioned within the receiving container 24 for depositing the articles therein.

While in accordance with the provisions of the Patent Statutes, the preferred forms and embodiments of the invention have been illustrated and described, it will be apparent to those of ordinary skill in the art the various changes and modifications may be made without deviating from the inventive concepts set forth above.

What is claimed is:

1. Apparatus for packaging articles such as serving cups from a conveyor into a container, comprising (a) a frame, (b) a vacuum housing rigidly mounted on said frame.

(c) a plurality of pickup assemblies connected with said vacuum housing and extending generally downward therefrom for grasping the cups with suction derived from said vacuum housing, each of said pickup assemblies including a conical member having upper and lower conical surfaces which taper toward upper and lower ends of said member, respectively; and (d) means cooperating with said pickup assembly conical members for shifting said pickup assemblies between an expanded configuration corresponding with the spacing of the conveyor and a compressed configuration corresponding with the dimensions of the container, said shifting means including a pair of parallel spaced horizontal plates, each of said plates containing an equal number of openings partially aligned so that a portion of said conical member of each pickup assembly passes through both plates, said conical member upper surface being arranged in an opening in an upper plate and said conical member lower surface being arranged in an opening in a lower plate, whereby vertical displacement of said plates away from said vacuum housing causes said upper plate openings to contact said upper conical surfaces to displace said pickup assemblies to the expanded configuration to grasp the cups from the conveyor, and vertical displacement of said plates toward said vacuum housing causes said lower plate openings to contact said lower conical surfaces to displace said pickup assemblies to the compressed configuration to release the cups into the container.

2. Apparatus as defined in claim 1, and further comprising a first pair of pneumatic cylinders connected between said vacuum housing and said pair of plates for vertically displacing said plates.

3. Apparatus as defined in claim 2, and further comprising suction heads connected with lower ends of said pickup assemblies, respectively.

4. Apparatus as defined in claim 3, wherein said plurality of pickup assemblies are pivotally connected with said vacuum housing in an array of columns and rows.

5. Apparatus as defined in claim 1, and further comprising:

a) a pair of said vacuum housings rotatably mounted on said frame, each of said vacuum housings having said plurality of pickup assemblies and positioning means associated therewith; and b) means for rotating said vacuum housings between loading and unloading positions, whereby in the loading position said vacuum housings are rotated to a position adjacent to the conveyor and in the unloading position said vacuum housings are rotated into a configuration corresponding with the receiving container.

6. Apparatus as defined in claim 5, wherein said rotating means comprises a pair of pneumatic cylinders, each of said pneumatic cylinders being connected between said frame and one of said vacuum housings for rotating said vacuum housings between the loading and unloading positions.

* * * * *